United States Patent [19]

Deric

[11] 4,308,935

[45] Jan. 5, 1982

[54] AUTONOMOUS ELEVATOR CAB OPERATION

[75] Inventor: J. Mark Deric, Johnson City, Tenn.

[73] Assignee: Otis Elevator Company, Hartford, Conn.

[21] Appl. No.: 107,801

[22] Filed: Dec. 27, 1979

[51] Int. Cl.[3] ..... B66B 13/24

[52] U.S. Cl. ..... 187/29 R

[58] Field of Search ..... 187/29

[56] References Cited

U.S. PATENT DOCUMENTS

| | | | |
|---|---|---|---|
| 3,519,105 | 7/1970 | Geil | 187/29 |
| 4,193,478 | 3/1980 | Keller et al. | 187/29 |
| 4,246,983 | 1/1981 | Bril | 187/29 |

*Primary Examiner*—Gene Z. Rubinson
*Assistant Examiner*—W. E. Duncanson, Jr.
*Attorney, Agent, or Firm*—M. P. Williams

[57] ABSTRACT

An elevator includes a microprocessor-based cab controller mounted on the elevator car to monitor calls for service by passengers in the car, such as are registered on car call buttons requesting stops at specific floors, door open and door close buttons and the like, controls the opening and closing of the door, monitors the position of the car relative to an adjacent landing and communicates with a microprocessor-based car controller which is disposed at the top of the shaftway and controls the motion of the car in the shaftway and provides commands to the cab controller, such as door opening and closing demands relating to hall calls at the landings, and the like. In the event that the cab controller determines that it cannot rely on communications between it and the car controller, the cab controller operates in an autonomous mode in which it will accept the presence of the car near a landing for a predetermined time as an indication that the car door may be open to allow passengers to escape, open the door, shuts off the lights in the car and sounds a buzzer to frighten passengers out of the car, and after the door is open for a period of time, closes the door and determines if the car is empty. If it is not empty, it again commands the door to open, shuts off the lights and sounds a buzzer. When it determines that the car is empty, the cab controller leaves the car parked with the lights off, but in a condition to be moved if the car controller desires to move it. An exemplary elevator system, including an exemplary microprocessor-based cab controller, a general door control program flowchart, illustrative of a system in which the present invention may be practiced, and detailed apparatus and flowcharts for practicing the present invention, are disclosed.

5 Claims, 7 Drawing Figures

MAINT DR MOTR CUR
29
I DICT
23
AMP/SCRs
22
ACTIVATE DR MOTR RELAY
24
27
28
NOT OP INH DR
25
I FB
31
26
21 TRANS
19
INTFC
18
16
14
13
20 DR CLSNG
12
9
8
10
7 CAB/ARM PIVOT
11
6
6
4
3
2
5
LINK/DOOR PIVOT
3
2
5 ARM/LINK PIVOT
4
DOOR-OPENED
DOOR-CLOSED
1 (OPEN)
1 (CLOSED)
EDGE OF OPENING

AUTONOMOUS ELEVATOR CAB OPERATION

DESCRIPTION

Technical Field

This invention relates to elevators, and more particularly to an emergency type of autonomous elevator cab operation which can allow passengers to leave the car in the event that the communication of signals between the controls on the elevator car and the controls at the head of the shaftway are deemed unreliable.

BACKGROUND ART

A typical elevator system includes an elevator car which is disposed to be moved up and down in an elevator shaftway adjacent to a plurality of floor landings. The motion of the car is controlled by a sheave motor and a brake, in response to commands thereto provided by a car controller which is usually mounted at the head of the shaftway, adjacent to the sheave, motor and brake. The car controller causes the motor to raise and lower the elevator, to decelerate and accelerate it, and to stop it at floor landings. The car controller generally keeps track of the position of the car in the shaftway, and the hall calls and car calls which are to be responded to. The car controller also notifies the cab controller when the car is stopping to allow passenger transfer, so that the cab controller can open the doors, and generally tells the cab controller when the doors have been open long enough and commands that the doors again be closed. The cab controller, in some cases, may assist in the leveling of the car by providing detailed information with respect to the position of the car with respect to an adjacent landing.

Communications between the cab controller (mounted on the car) and the car controller (mounted in a machine room) has typically either been by direct wire connections or employing time division multiplex over a few wires, the wires in either case being in what is typically called the traveling cable between the elevator car and the machine room. Where direct wiring is used for every signal, the car controller and cab controller typically employ mechanical switches and magnetic relays, which are inherently difficult to maintain. On the other hand, where multiplexing is employed, the failure of one or two devices in the electronic circuitry which handles the multiplexing may result in a failure of communication between the car and the cab. Whenever there is a communication failure between the cab controller and the car controller, the car controller is unable to command the doors to be opened and/or closed in a proper fashion. In prior systems, this has typically resulted in the passengers being trapped in the car, and being released only after the intervention of maintenance personnel. This is typically true even though the car may be standing at a landing so that the passengers could escape safely if the commands could be provided to open the door.

DISCLOSURE OF INVENTION

Objects of the invention include provision for passengers to leave an elevator car in the event of communication failure between the car and a related car controller which is disposed remotely therefrom and connected thereto.

According to the present invention, in the event that a cab controller on an elevator car detects a condition where communications cannot be deemed to be reliable between the elevator car and a remotely positioned car controller which is connected thereto, the cab controller monitors the position of the car relative to an adjacent floor landing, and when the car is within a predetermined distance of the landing for a determined time, inhibits car motion and commands the door to open. According further to the invention, when the door has been open for a predetermined time, it is closed and the cab controller checks to see if the car is empty; if not, it again commands the door to open, holds it open for a time, and then commands it to close and checks to see if the car is empty. When the car is empty, the door is closed and car motion is once again enabled.

In further accord with the present invention, each time that the car door is opened when in the communication failure mode, the cab controller causes the lighting of the car to go off and sounds a buzzer to urge passengers out of the cab.

The invention provides a relatively simple and nontraumatic way to allow passengers to exit from an elevator car when communication failures are likely, and the car will not otherwise receive door open commands from a remotely disposed car controller connected therewith. The invention is readily implemented utilizing apparatus and techniques which are well within the skill of the art in the light of the specific teachings of the invention as described hereinafter.

The foregoing and other objects, features and advantages of the present invention will become more apparent in the light of the following detailed description of an exemplary embodiment thereof, as illustrated in the accompanying drawings.

BEST MODE FOR CARRYING OUT THE INVENTION

Figure 1:
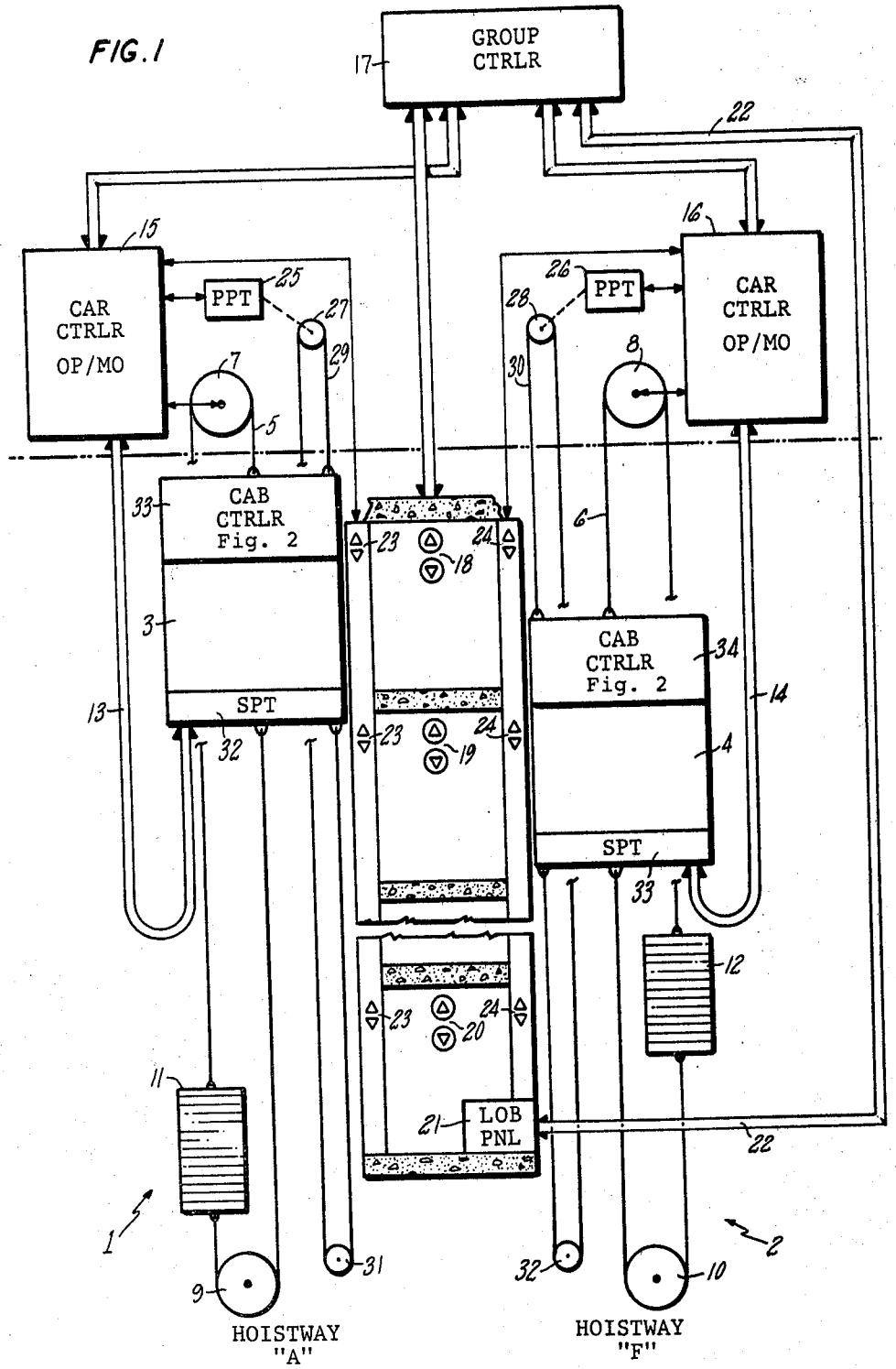
FIG. 1 is a simplified, schematicized view of an elevator system in which the present invention may be practiced.

A simplified description of a multi-car elevator system, of the type in which the present invention may be practiced, is illustrated in FIG. 1. Therein, a plurality of hoistways, HOISTWAY "A" 1 and HOISTWAY "A" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissable load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for vertification of floor position information derived by the PPT 25, 26, may employ a secondary position transducer (SPT) 32, 33 of the type disclosed and claimed in a commonly owned copending U.S. application filed on Nov. 13, 1979 by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself are directed, or communicated with, by means of a cab controller 33, 34 in accordance with the present invention, and may provide serial, time-mutiplexed communications with the car controller as well as direct, hard-wired communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor. The cab controller interfaces with load weighing transducers to provide weight information used in controlling the motion, operation, and door functions of the car. The load weighing may be in accordance with the invention described and claimed in commonly owned copending patent applications filed on Nov. 27, 1979 by Donofrio, Ser. No. 098,004 and by Games, Ser. No. 098,003, now abandoned. A most significant job of the cab controller 33, 34 is to control the opening and closing of the door, in accordance with demands therefore under conditions which are determined to be safe.

The makeup of microcomputer systems, such as may be used in the implementation of the car controllers 15, 16, a group controller 17, and the cab controllers 33, 34, can be selected readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varath Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Mass., U.S.A. And, Simpson, W. D., Luecke, G., Cannon, D. L., and Clemens, D. H., "9900 Family Systems Design and Data Book", 1978, published by Texas Instruments, Inc., Houston, Tex. U.S.A. (U.S. Library of Congress Catalog No. 78-058005). Similarly, the manner of structuring the software for operation of such computers may take a variety of known forms, employing know principles which are set forth in a variety of publications. One basic fundamental treatise is "The Art of Computer Programming", in seven volumes, by the Addison-Wesley Publishing Company, Inc., Reading, Massachusetts, and Menlo Park, Calif., U.S.A., London, England, and Don Mills, Ontario, Canada (U.S. Library of Congress Catalog No. 67-26020). A more popular topical publication is "EDN Microprocessor Design Series" published in 1975 by Kahners Publishing Company (Electronic Division News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments 9900 family, and suitable interface modules for working there with, an elevator control system of the type illustrated in FIG. 1, with separate controllers for the cabs, the cars, and the group, has been implemented utilizing real time interrupts, power on causing a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the control register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Figure 2:
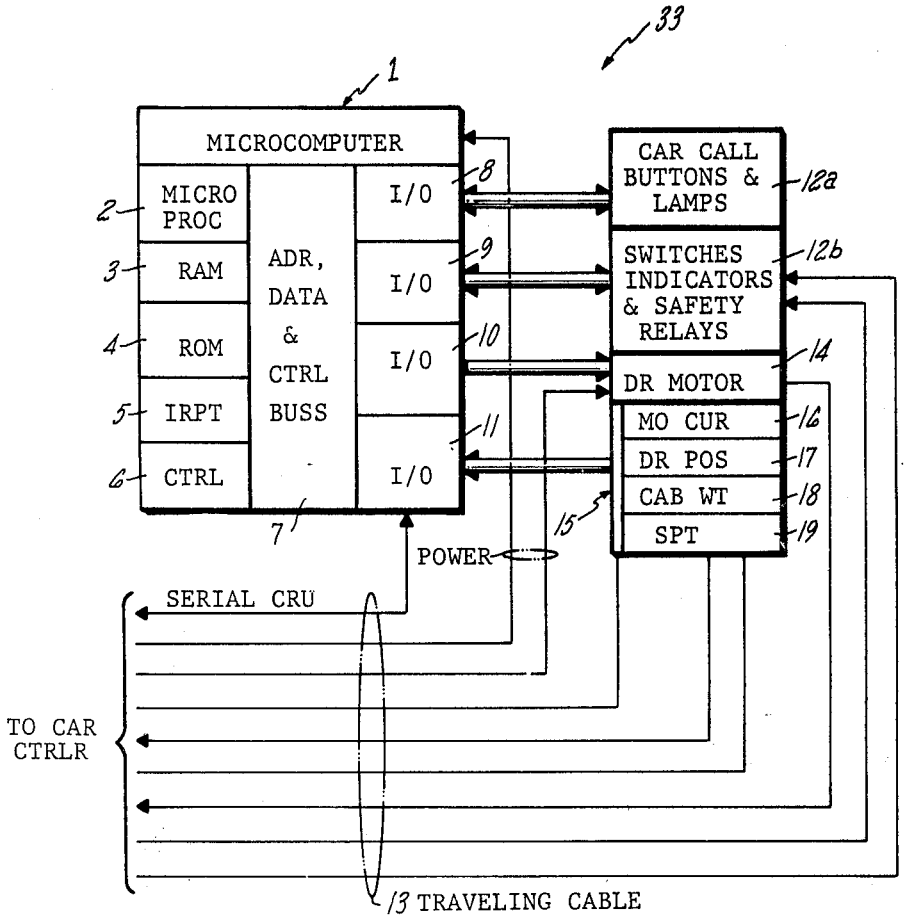
FIG. 2 is a simplified block diagram of a controller which may be utilized in the elevator system of FIG. 1.

Referring now to FIG. 2, a cab controller 33 is illustrated simply, in a very general block form. The cab controller is based on a microcomputer 1 which may take any one of a number of well-known forms. For instance, it may be built up of selected integrated circuit chips offered by a variety of manufacturers in related series of integrated circuit chips, such as the Texas Instruments 9900 Family. Such a microcomputer 1 may typically include a microprocessor (a central control and arithmetic and logic unit) 2, such as a TMS 9900 with a TIM 9904 clock, random access memory 3, read only memory 4, an interrupt priority and/or decode circuit 5, and control circuits, such as address/operation decodes and the like. The microcomputer 1 is generally formed by assemblage of chips 2–6 on a board, with suitable plated or other wiring so as to provide adequate address, data, and control busses 7, which interconnect the chips 2–6 with a plurality of input/output (I/O) modules of a suitable variety 8–11. The nature of the I/O modules 8–11 depends on the functions which they are to control. It also depends, in each case, on the types of interfacing circuitry which may be utilized outboard therefrom, in controlling or monitoring the elevator apparatus to which the I/O is connected. For instance, the I/Os 8, 9 being connected to car control buttons and lamps 12*a* and to switches and indicators 12*b* may simply comprise buffered input and buffered output, multiplexer and demultiplexer, and voltage and/or power conversion and/or isolation so as to be able to sense car call button closure and to drive lamps with a suitable power, whether the power is supplied by the I/O or externally. Similarly, the I/O 9 may be required to cause a floor warning gong or an emergency buzzer to sound, to light indicators indicative of elevator operating mode, and to sense switches (such as an emergency power switch, or key switches for express operation and the like), and to operate and monitor door motor safety relays.

On the other hand, the I/O 10 must either service an amplifier indicated as part of a door motor 14, or it must provide the amplification function. In such case, the I/O 10 may be specifically designed to be used as an I/O for a door motor 14; but if the door motor 14 includes its amplifier and monitoring circuitry, then a conventional data I/O 10 may be used. Similarly, an I/O 11 communicating with multi-functional circuitry 15, including door motor current feedback 16, a door position transducer 17, cab weight transducers 18, and a secondary position transducer 19 (which indicates the position of the car with respect to each floor landing) may be a general data I/O device if the functions are provided for in the circuitry 15, or it may be a specially-designed I/O device so as to perform necessary interfacing functions for the specific apparatus 16–19.

Communication between the cab controller 33 of FIG. 2 and a car controller (such as car controller 15 illustrated in FIG. 1) is by means of the well known traveling cable 13. However, because of the capability of the cab controller 33 and the car controller 15 to provide a serial data link between themselves, it is contemplated that serial, time division multiplexed communication, of the type which has been known in the art, will be used between the car and cab controllers. In such case, the serial communication between the cab controller 33 and the car controller 15 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired.

The traveling cable also provides necessary power to the microcomputer 1 as well as to the door motor 14. For instance, ordinary 60 hz AC may be supplied to the microcomputer 1 so that its power supply can provide integrated circuit and transistor operating voltages to the various chips within the microcomputer 1, and separate DC, motor-operating power may be provided to the door motor 14. Other direct communications, such as between the secondary position transducer and the operation controller may be provided by hard-wiring in the traveling cable. Although not illustrated herein, additional wires for safety switches, power, and the like are also typically provided within the traveling cable. The desirability, however, of utilizing serial, time-division multiplex communications between the cab controller 33 and the car controller 15 is to reduce to two, the number of wires which may be necessary to handle as many as 200 discrete bits of information (such as car direction, request to open the door, car call registrations for particular floors, and the like). However, this forms no part of the present invention and is not described further herein.

Figure 3:
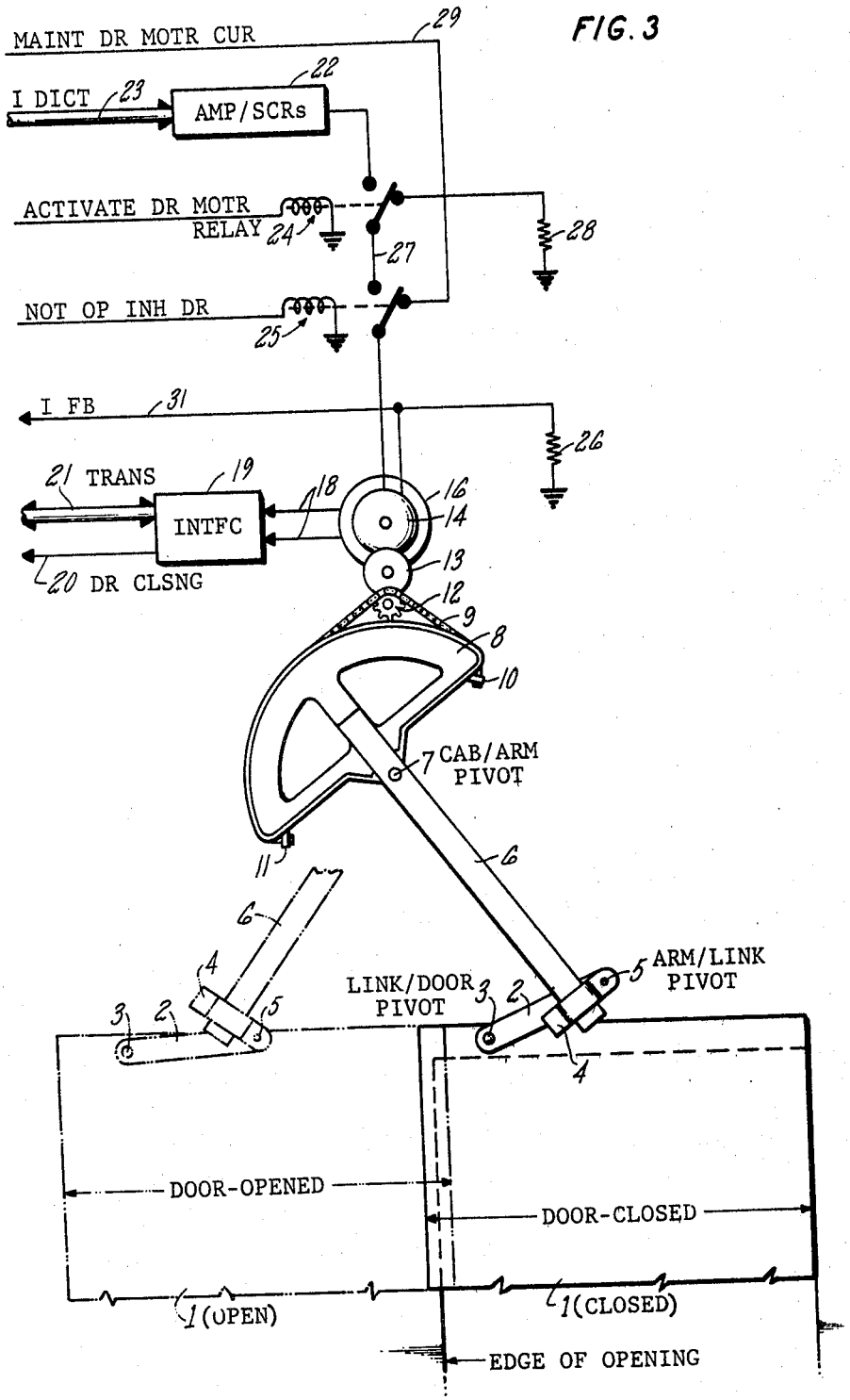
FIG. 3 is a simplified, broken away schematicized illustration of an elevator door operator for use with the present invention.

The door opening and closing controls described herein are capable of being utilized with virtually any type of elevator door which is desired. In order to understand the complexities of door operation more fully, a typical door operator is illustrated in FIG. 3. Therein, a door 1 is shown, partially broken away at the bottom, in solid lines in a fully closed position (to the right in FIG. 3), in heavy dashed lines in a fully open position (to the left in FIG. 3). The door is connected to a link 2 by a pivot 3 which in turn is connected to an arm slider member 4 by a pivot 5. The member 4 has an arm 6 passing there through such that the member 4 must revolve about a pivot 7 of the arm 6 as the arm revolves, but the member 4 may slide longitudinally along the arm 6, in a well-known fashion. The arm 6 is formed integrally with or connected to an arcuate member 8 to which there is connected a chain 9 affixed thereto at points 10, 11. The chain 9 engages a sprocket 12 which is driven through reduction gears 13 by a door motor 14. To open the door, as depicted in FIG. 3, the motor turns in the clockwise direction, causing the arcuate member 8 and the arm 6 to similarly rotate in the clockwise direction about the pivot 7. The arm therefore pulls on the link 4 driving it to the left or open position, which in turn drives the link 2 and therefore the door 1 through the pivot 3. As the door moves toward the open position, the link 2 rotates clockwise about the pivot 3, and the link 4 rotates clockwise about the pivot 5. At the end of travel, in the fully-open position, the links 2, 4, and the arm 6 have the position shown broken away at the left in FIG. 3.

The necessary consequence of the convention of rotary motion to linear motion, as depicted in FIG. 3, is that the distance (as in centimeters) of the door motion per unit angle of revolution (as in degrees) of the motor 14 varies in dependence upon the actual door position. For instance, it is evident from FIG. 3 that the maximum door motion per increment of motor angle will occur when the door is midway between the open and close position, and will be somewhat less near the fully-opened or fully-closed positions. This variation in linkage is accommodated by means of a map or table of empirically determined values of incremental changes in door position for changes in motor position, as a function of door position.

When the arm 6 is vertical, its weight creates no force on the arm slider member; but when it is in any other position, the weight of the arm 6 affects door motion. During the first half (approximately) of travel, the arm aids motion (in either direction), but it impedes motion during the second half.

The actual door position may be monitored by a door position transducer 16 which is connected to the door motor shaft (or on the same shaft) or may be driven by the door motor in some other suitable fashion, such as a rack and pinion to provide a pair of phase related (direction indicating) bits over lines 18 to interface circuitry 19, which includes means to determine from the relative time of occurrence of the bits on the lines 18 whether the door is closing or opening, and thus provide the door closing flag signal on a line 20, and to sense the number of bits per cycle as an indication of door velocity and transmitting an indication thereof as the TRANS bits on lines 21. This circuitry may take the form of so much of the circuits described in the aforementioned Masel et al. U.S. Patent Application as is necessary to acquire direction and count information from a single incremental encoder with quadrature output. The door position is derived by accumulating these bits elsewhere, followed by conversion from angles of rotation to actual door position.

Although not intended to be an accurate description of the manner in which the motor may be driven, FIG. 3 illustrates that a door amplifier circuit 22 may be provided with a digital value of dictated current on a bus of lines 23 to generate the desired current for the motor 14. The current is applied to the motor 14 only if a pair of safety relays 24, 25 are suitably activated, as described hereinafter with respect to FIG. 9. And a sensing resistor or the like 26 may provide a motor amplifier feedback current value on a line 31 to the cab controller 33. More specifically, the safety relay 24 is actuated by the door control routines when no faults or failures are detected by the self health subroutines. Actuating the relay 24 connects a circuit 27 with the amplifier 22. On the other hand, if the relay 27 is disenergized (as shown), it will connect the circuit 27 to a grounded resistor 28 which provides dynamic braking to the door motor, in the fashion long known in the art. The relay 25 is controlled by the operation controller, in the car controller, and is activated when the car controller determines that operation of the door should be left in the hands of the cab controller. But if the car controller senses that operation of the motor should absolutely be inhibited, or vetoed, then the relay 25 will be disenergized (as shown) so as to prevent the amplifier 22 from providing current to the motor 14. And, when in the disenergized state, the motor 14 is connected by means of a direct circuit 29 to the machine room to facilitate control of the motor by maintenance personnel directly from the machine room, such as to effect an emergency evacuation from an elevator cab. A specific condition that would cause the operation controller to disenergize the relay 25 is loss of motive power, with passengers in the elevator, and an inability to force the door open through normal logical control.

As illustrated in FIG. 3, a complete door control routine will consist of many subroutines to determine operating conditions, such as the position of the car with respect to a landing, commands to open and close the door, the health of various transducers, door reversal devices, and the like, to determine whether the door should be open, opening, closed, or closing, and if door motion is required, to determine whether it should be done at a slow final velocity, in accordance with a velocity profile that is position controlled, or if it should be accomplished with a principally timecontrolled velocity profile. And, when the door is impeded or against its open or closed stops, the nature of stall current which should be dictated to the door motor. Various other features are performed in the enhancement of door motor operation, as is described more particularly hereinafter.

The door control routine may be entered from the executive program based upon real time interrupts decoded to the frequency that is required of the door control program, such as about every 16 milliseconds. The program is reached through an entry point 1, and the first subroutine therein 2 is referred to as autonomous mode, which provides for sensing a failure of communication between the cab controller and the car controller, inhibiting car motion near a landing, opening and closing the doors while turning the lights on and off and sounding a buzzer to frighten the passengers off the car. As described more fully and claimed in a commonly owned copending U.S. patent application filed on even date herewith by Doane, Deric, and Roberts, Ser. No. 107,691, in a safety check subroutine 3, various factors which can control the safe response to door motion commands are taken into account (such as the car being close to a landing) to permit commanded door operation only when safe, and to force safe door conditions when necessary. In an initiation subroutine 4, specific door initialization during a power on reset are made, and various conditions are established during normal operations at the start of each pass through the door control routine so as to control the functioning thereof.

In a door position/velocity subroutine 5, the door motion transducer increments are monitored and converted to linear door position and velocity factors, as well as providing a linkage ratio as a function of door position for use in door motor compensation and current calculations. In a door direction subroutine 6, commanded door direction and reversal requests are processed. A compensation subroutine 7 provides motor current compensation components to take into account the weight of the door actuator arm, friction, and the force of the hoistway door spirator or spring.

Determination of whether stall current should be dictated to the motor or a velocity profile should be dictated to the door motor is accommodated in a velocity/stall subroutine 8. Stall current is dictated to the door motor in a stall dictation subroutine 9, which stall is indicated by the subroutine 8, and motor current is outputted by a subroutine 9*a*. Otherwise, the factors for a position-controlled velocity profile may be selected, in a position-controlled profile select subroutine 10 or the factors for a time-controlled velocity profile may be selected in a time-controlled profile selection subroutine 11. These are factors such as the maximum acceleration and velocity, final velocity, and conditions for changing from one acceleration or rate of acceleration to another as the door is moved.

Selection of suitable acceleration and velocity factors is performed in a subroutine 12, a positioncontrolled velocity is dictated in a subroutine 13, and time-controlled velocity as well as the variance between actual and dicated velocity are provided in a subroutine. Actual current is calculated and modified in accordance with specific conditions in the dynamic compensation subroutine 15 and outputted in the subroutine 9*a*, which completes the door control program whenever it involves dictated velocity profiles.

Figure 4:
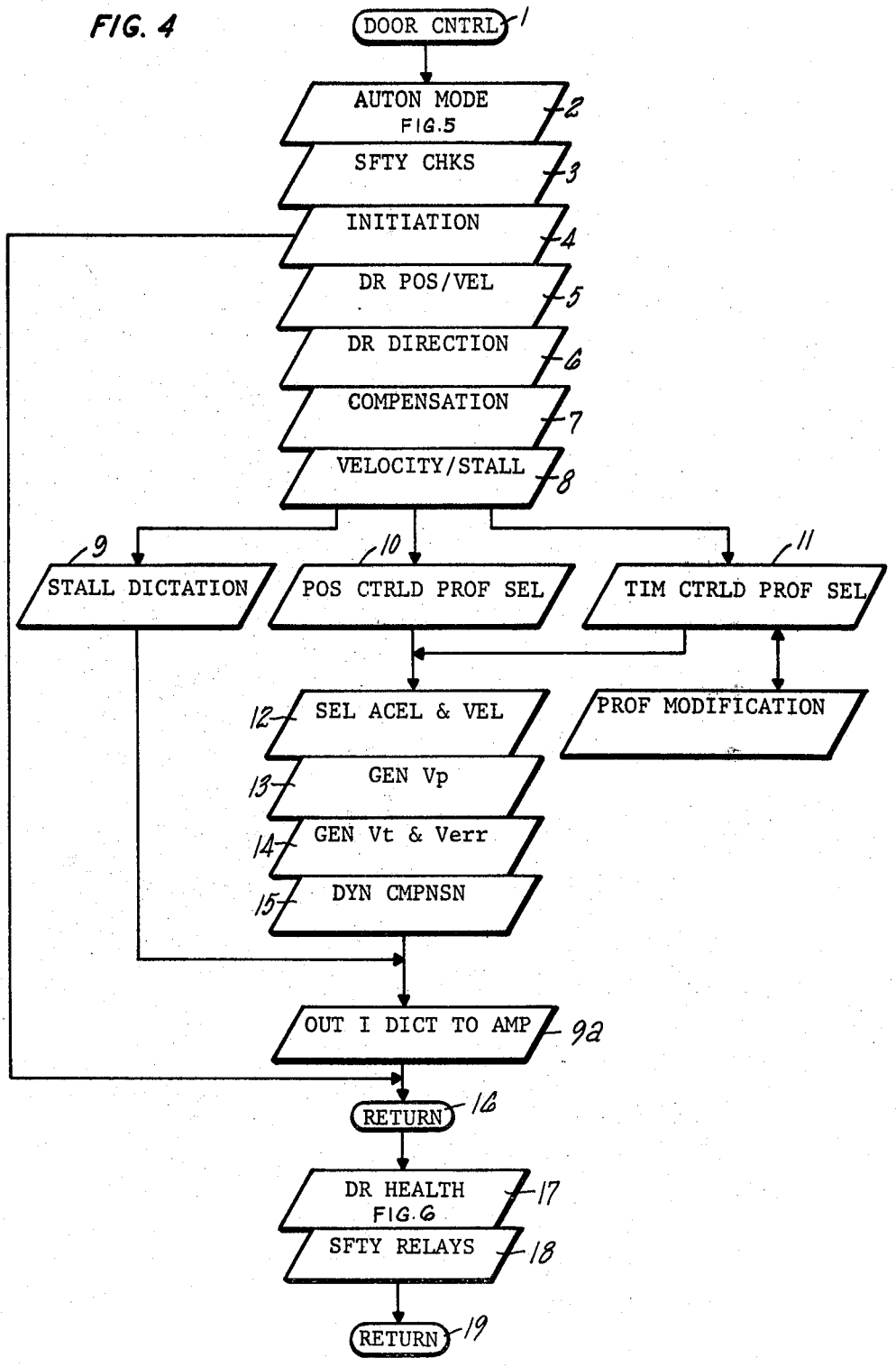
FIG. 4 is a logic flow diagram of the subroutines of a door control routine and door health and safety subroutines, which may be utilized in implementing the present invention and/or its environment.

The door control program of FIG. 4 may return to the executive through a transfer point 16, and then a door health routine 17, including a safety relay subroutine 18, monitors certain conditions indicative of the health of the door operation function, and sets and monitors safety relays that may absolutely inhibit the car motion or door motion in dependence upon the safety conditions of the subroutine 17 or in dependence upon conditions in the operation controller in accordance with the invention. Normally, the door health subroutine 17, 18 will be performed following the door control routine, in each case. Completion of all of the door control functions will cause return to the executive program through a transfer point 19.

All of the functions of the door control routine of FIG. 3 not described in detail hereinafter are described in a commonly owned copending U.S. patent application filed on even date herewith by Hmelovsky and Games, Ser. No. 107,804.

The autonomous mode provides for emptying the car in the case the communications between the cab and its operational control (in the car controller, as described hereinbefore) have failed. This distinguishes from prior elevator systems in which the hard wiring provided in the traveling cable between the cab and the machine room associated with the shaftway was always assumed to be operative, and if the communications provided by that hard wiring failed, then a catastrophic failure of a stuck elevator was allowed to occur, the only solution being the intervention of maintenance personnel. But with the thought by some members of the public that the multiplexing of data between the cab and the car is less reliable than hard wires for each indicium of data which is required, an additional operational mode is provided through an entry point 1 indicated in FIG. 5. All data transfers between the car controller (15, 16 FIG. 1) and the cab controller (33, 34, FIG. 1) are checked in the cab controller, such as with common parity and longitudinal redundancy checks and handshakes. Any error causes the cab controller to generate a communication failure flag. In test 2, if communications are determined not to have failed, step 3 resets a door once flag to ensure that, once communications have been reestablished if they had failed, this flag is guaranteed to be in the reset state. And a step 3*a* resets the inhibition of car motion (as described below), to allow services to be restored in the event that communications are restored before the door is opened. Then, this subroutine is exited by means of the transfer point 4. But if step 2 indicates that there has been a communication failure, due to improper operation of the handshake communications and/or data checks described hereinbefore, then a test 5 determines whether the cab has been within the inner door zone (that is within about 7.5 cm of the floor) for more than 10 seconds. If it has, the car must hve been ordered to stop by the car controller; a lesser time could be indicative of the car just passing by a floor, without stopping. If it has not, then it must be assumed that the car has not come to rest and, it is also assumed that the car could continue to have motion and approach a floor sufficiently to allow passengers to escape. For that reason, a step 6 resets an autonomous mode inhibit car motion flag, the lights are maintained on by setting an enable functional lighting flag in step 7, a buzzer command bit is reset in step 8, since there is no need to try to "chase" or "scare" the passengers out of the cab by sounding a buzzer, and the door is prevented from opening by ensuring that the door open demand is reset in step 9.

If the car is still moving toward a floor at which it is commanded to stop, eventually the cab will be within the inner door zone for 10 or more seconds. Thereafter, the purpose of the autonomous mode of operation is to cause the car to stop, to thereafter command its doors to be opened, to intimidate or scare the passengers out, by turning off the lights and sounding a buzzer, to re-enable the lighting and stop the buzzer, close and open the doors, and so forth, as is described more fully below. In such case, all subsequent passes through the autonomous mode subroutine when tests 2 and 5 indicate that there has been a communication failure and the car has been within the inner door zone for more than 10 seconds, will commence with a test 10 to determine if the door has been fully open once. This is accomplished because the door once flag of step 11 can be set only upon failing the test, which can occur only before that flag is set when the doors are fully open. And once that flag is set, it can only be reset by step 3, which can only be accomplished by removing the communication failure as indicated in step 2. Thus, so long as a communication failure continues, after the door once flag 11 is set the first time, test 10 will be negative, regardless of whether the door is fully open or not. Until the door once flag is set, the outcome of test 10 depends only upon whether the door is fully open or not, if the door is not fully open, the test will be affirmative. This causes the autonomous mode inhibiting of car motion in step 12, the functional lighting to be enabled (to keep the lights on in the car) in step 13, the buzzer command to remain reset in step 14, but the door is conditionally demanded to be open in step 16 by setting the door open demand bit. As a consequence of the door open demand being set, dependent upon other safety conditions which are described with respect to FIG. D2 hereinafter, eventually the door will be fully open if it can be. This will cause step 10 to fail so the door once flag will be set in step 11. And, on the first passage through step 11, a test 16 will necessarily be affirmative causing car motion to be inhibited in step 17 by setting the autonomous mode inhibit car motion bit, the lights in the car are turned off in step 18 by resetting the enable functional lighting bit, and the buzzer is caused to sound by setting the buzzer bit in step 19. This is designed to ensure that the car stays put (as described with respect to FIG. 9, hereinafter), and to frighten the passengers out of the car by having the lights go off and the buzzer on while the door is fully open (test 16). This will continue in subsequent passes until a test 20 determines that the door has been fully open for 10 seconds. And the door will remain fully open for 10 seconds since an affirmative result of test 20 is required in order for the open door command (indirectly generated by the door open demand of step 15) to be reset in step 21.

The closing command resulting from step 21 (FIG. 5) will ultimately cause the door to leave the fully open position so that test 16 will be negative. This causes a test 22 to determine if the doors have reached the fully closed position. During the period of time necessary to close the doors, each pass through the autonomous mode subroutine will reach test 22 and fail, causing car motion to remain inhibited by step 23 setting the autonomous mode inhibit car motion bit, keeping the lights on once the doors start to close by step 24 enabling the functional lighting, and causing the buzzer to be off by resetting the buzzer bit in step 25. Thus, after the doors have been open for 10 seconds and begin to close, the buzzer goes off and the lights go back on. Eventually, after the doors are fully cloed, test 22 will be affirmative, and the car empty indication is interrogated in step 26. If the car is not determined to be empty, the door is indirectly commanded to be open by step 27 (which is similar to step 15) and will ultimately cause the doors to become open, so that test 16 will cause a repeat of steps 17-21. And, car calls are inhibited by resetting the enable new car calls bit in step 28. This prevents any passengers from deciding that they would like to use the elevator while it is in the autonomous mode due to a communication failure. Eventually, the logical conditions indicative of an empty car may become apparent so that step 26 will be affirmative. In that case, a test 29 is made to determine if the further assurance of emptiness has been established as indicated by the car really empty bit. If not, nothing further is done. Eventually, if the car is really empty (as determined by the load weight or elapsed time without any button activity, in the manner described fully and claimed in a commonly owned copending U.S. patent application filed on even date herwith by Bittar and Deric, Ser. No. 107,672, then the car is determined to be capable of waiting in a lights-off, door-closed, motion-enabled condition, and step 30 will reset the autonomous mode inhibit of car motion and step 31 will turn off the lights by resetting the enable functional lighting bit. In every subsequent passage through the autonomous mode subroutine as long as the communication failure continues, the path will be through tests 5, 10, 16, 22, 26, and 29 to steps 30 and 31. In each passage through the autonomous mode, exit is made through the transfer point 4 in FIG. 5, to the safety checks subroutine 3 (FIG. 4).

Figure 6:
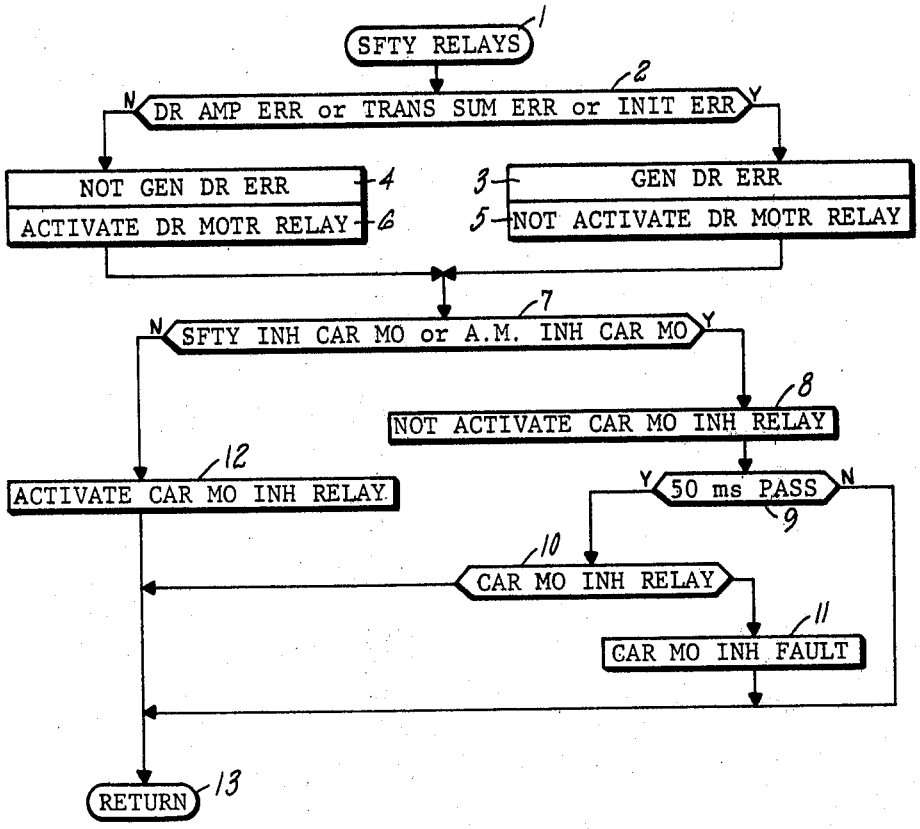
FIG. 6 is a logic flow chart of a safety relays subroutine.

In FIG. 6, a safety relays subroutine is reached by an entry point 1 and a test 2 determines whether various errors have been set to set the general door error flag in step 3, or reset it in step 4, and deactivate the door motor relay (24, FIG. 3) in step 5, or activate it in step 6.

Figure 5:
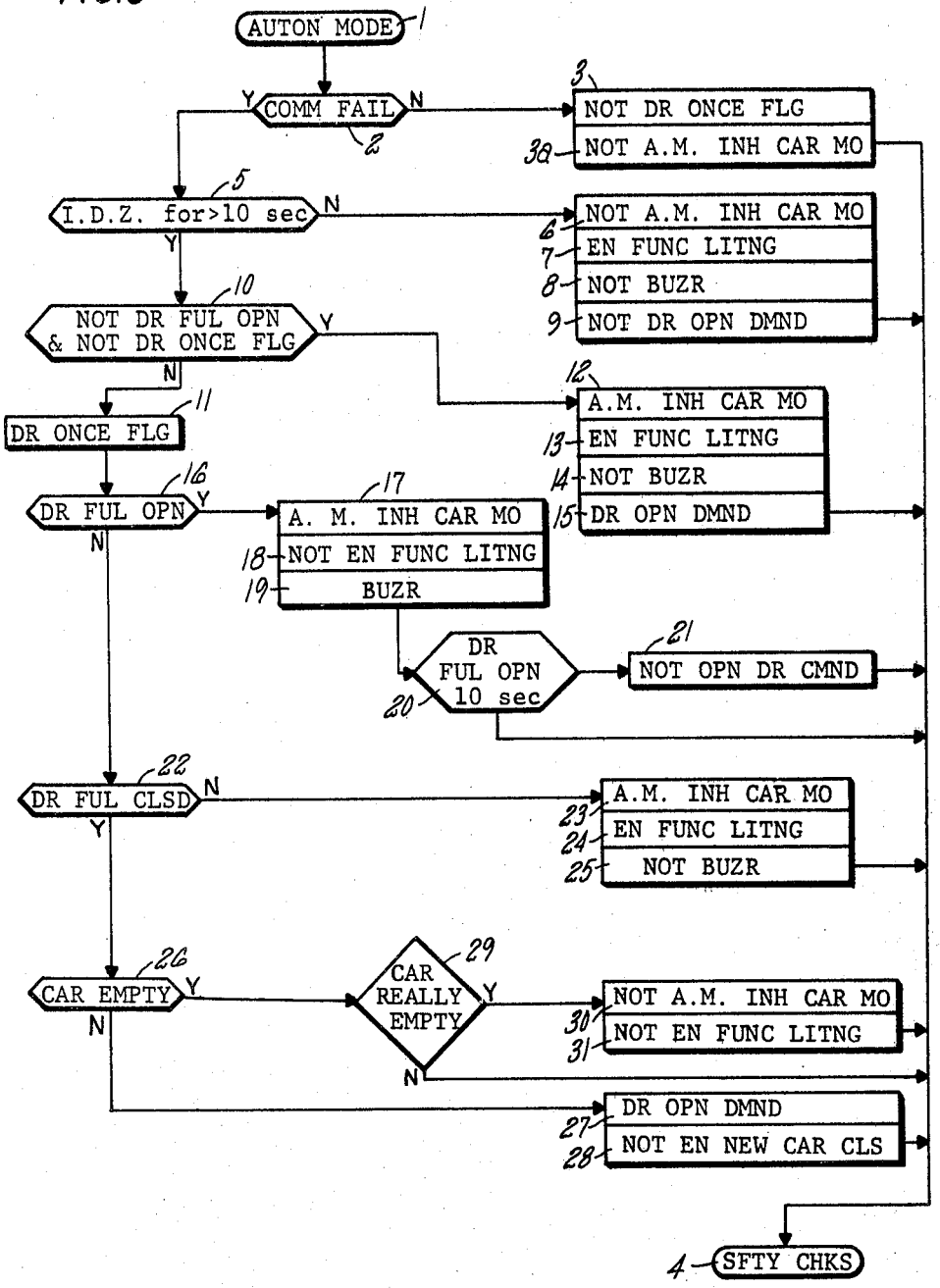
FIG. 5 is a logic flowchart of an autonomous mode subroutine.

If the autonomous mode inhibit car motion flag is set in steps 12, 17, or 23 of the autonomous mode subroutine in FIG. 5, this will be sensed in a test 7 which casues a step 8 to deactivate a car motion inhibit relay, which is a command to the operation control to have a specific relay operated that prevents car motion absolutely, such as a relay in series with the sheave-driving motor of the elevator. Once step 8 deactivates the car motion inhibit relay, a 50 milisecond time out in performed in test 9; if the operational control has not provided a signal back to the door program within 50 milliseconds after the door control program indication to the operation controller that the inhibit relay should be deactivated, test 10 will be negative and a car motion inhibit fault flag will be set in test 11. This fault is transmitted to the operation controller to indicate that it has demanded that car motion be inhibited and has not been advised that such is the case.

In the event that test 7 shows that the door control program has not commanded that the car motion be inhibited, a step 12 will ensure that the car motion inhibit relay is activated. Following step 11 or step 12, the door health program is completed and processing is returned to the executive program by means of a return point 13.

Figure 7:
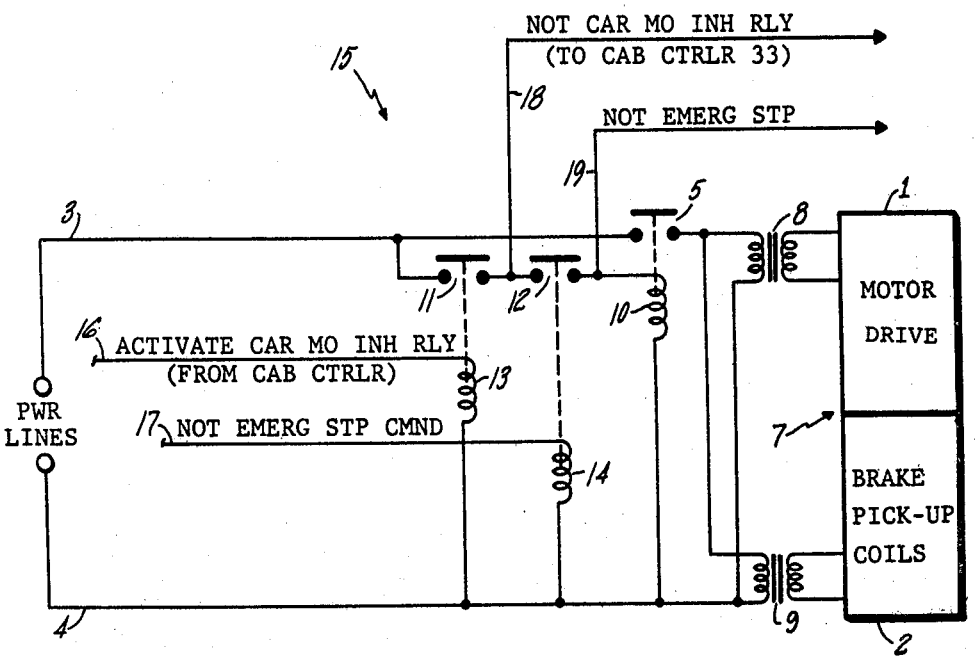
FIG. 7 is a simplified schematic diagram of car motion inhibit means.

Referring now to FIG. 7, a portion of the car controller 15 (FIG. 1 and FIG. 7) is illustrated as including means for controlling the application of power to the motor field 1 and brake pick-up coils 2 of the sheave/-motor/brake assembly 7 (FIG. 1 and FIG. 7). Specifically, operating power is provided from a pair of power lines 3, 4 to a normally open main relay contact 5 to a pair of transformers 8, 9 which provide power to the motor field 1 and the brake pick-up coils 2. The motion of the car is totally inhibited and arrested whenever the relay contact 5 is open because the motor will have no field excitation and the spring-loaded brakes (typical in most elevator installations) will be operable because the pick-up coils 2 will have no power applied thereto.

In FIG. 7, the relay contact 5 is normally open and is closed when a related relay coil 10 is energized by power applied from the line 3 through additional normally-open relay contacts 11, 12. The relay contacts 11 and 12 are in turn closed when power is applied to related coils 13, 14 by signals applied on corresponding lines 16, 17. The signal on the line 17, which has nothing to do with the present invention, is normally generated whenever there is not en emergency stop command indicated by failure of a variety of safety checks in the car controller (15, FIG. 1), of the type which is well known in the art. On the other hand, the signal on the line 16 is generated in response to the presence of a similarly named flag bit, activate car motion inhibit relay, which is generated in step 12 of FIG. 6 in the event that the autonomous mode of the present invention has sensed the communication failure, determined the car to be in the inner door zone for a requisite period of time and set the A.M. inhibit car motion flag in a step 12 or step 23 of FIG. 5, as described hereinbefore, which is tested in test 7 of FIG. 6, as described hereinbefore. During the autonomous mode when car motion is to be inhibited, test 7 of FIG. 6 will be affirmative and step 8 will reset the activate car motion inhibit relay, so no signal will appear on line 16 of FIG. 7. In such a case, the relay contact 11 will become open, causing the relay coil 10 to be disenergized, so that the main contact 5 will open, assuring that motion of the car is arrested.

When the contact 11 is open, there is no signal on a line 18 which is connected to the cab controller 33 (FIG. 1) and which provides the basis for the logical bit to be tested in test 10 of FIG. 6, as described hereinefore. A similar feedback or monitor line 19 may provide information to the car controller indicating an emergency stop event (whether caused by the lack of an activate car motion inhibit relay signal on the line 15, or otherwise. This forms no part of the invention and is not described further herein.

From the foregoing description, it can be seen that the autonomous mode can be called into play as a consequence of any indication desired, communication failure being described herein as the means of so doing. In the present embodiment, the communication failure which is tested (test 2, FIG. 5) is contemplated as being any indication of a problem in the normal data transfer tests (such as parity, longitudinal redundancy, and the like) which are performed by typical signal processors in handshake type communications. However, this test could be developed in response to other indications of communication failure or other indications of failure of the ability of the car controller to provide the door controlling signals which the car otherwise would require.

The salient features of the embodiment herein is that car motion is inhibited by breaking the power input to the elevator car motion motor and the brake pick-ups, as described with respect to FIG. 7 herein. This takes place as soon as the autonomous mode routine determines that the car is within the inner door zone for ten seconds. This function is performed directly by the car because the secondary position transducer (32, FIG. 1) is the source of information therefor. At the time that motion is inhibited, the door is demanded to be open. A secondary feature of the invention is provision of a buzzer sound and the absence of lighting in the car, while the door is opening, when open, and while closing, to frighten the passengers out of the car. When the door is fully open for a requisite period of time (test 20, FIG. 5) the door is commanded to again close; and when the car is closed, the car empty function (described more particularly with respect to the aforementioned copending application of Bittar and Deric) may be utilized to determine if the car is empty; or some other method could be used. If it is not empty, the portion of the program commencing with opening of the door is repeated. But if the car is really empty, the inhibiting of car motion is removed and the lights are shut off, with the door closed.

It should be obvious that certain changes in the implementation could be made if desired. For instance, once the car is determined to be empty, in conjunction with other detectable events, the door of the car could be left open rather than closed such as to facilitate firemen service, or the like. Other modifications could also be made to tailor the invention to a particular utilization having slightly different characteristics than those disclosed herein. However, the salient feature is that with communication problems, car motion is inhibited and door opening is demanded whenever the cab controller can determine that the car is probably reasonably adjacent to a landing, and the inhibiting of car motion is not removed until the doors have been open sufficiently to allow passengers to leave the car and again closed, and the car is determined to be empty.

Similarly, although the invention has been shown and described with respect to an exemplary embodiment thereof, the foregoing and various other changes, omissions and additions may be made therein and thereto, without departing from the spirit and the scope of the invention.

I claim:

1. An elevator for servicing a plurality of floor landings adjacent an elevator hoistway in a building, comprising:

hall call means for registering requests for up or down service at each of said landings;

a car movably disposed in said hoistway;

car motion means for providing and arresting the motion of said car;

car controller means for providing signals indicative of conditions of said car and of said car motion means, for exchanging signals with said car, for controlling said car motion means to cause said car to move in a selected up or down direction in said hoistway and to stop in response to said signals indicative of conditions of said car and of said car motion means and to signals received from said car;

said car including a door for providing access to and from said car, a door motion means for opening and closing said door, switch means for registering calls for service by passengers in said car, and a cab controller comprising means for providing cab signals indicative of calls for service registered by said switch means, conditions of said car, and the occupied or empty status of said car, for determining that the floor of said car is within a given distance of one of said landings and providing a door zone signal indicative thereof, for exchanging signals with said car controller, and for controlling said door motion means in response to said cab signals and in response to signals received from said car controller;

characterized by said car controller including inhibit means operative in either of two states for enabling said car motion means to move said car when in a first one of said states and for forcing said car motion means to arrest the motion of said car when in the second one of said states; and said cab controller comprising signal processing means for providing a communication failure signal indicative of a failure in exchanging signals between said cab controller and said car controller and in response to said failure signal, for setting said inhibit means into said second state and providing a door opening command to said door motion means in response to concurrent presence of said failure signal and said door zone signal.

2. An elevator according to claim 1 further characterized by said signal processing means comprising means for monitoring the position of the door, for providing a door closing command to said door motion means when the door is open for a time interval to allow passenger egress from said car in response to said door opening command, for determining when the door is closed in response to said door closing command and, in response thereto, setting said inhibit means into said first state if said cab signals indicate that said car is empty.

3. An elevator according to claim 2 further characterized by said signal processing means comprising means for determining when the door is closed in response to said door closing command and, in response thereto, for providing a door opening command to said door motion means if said cab signals indicate that said car is not empty.

4. An elevator according to claim 3 further characterized by said car including means for determining that the floor of said car is within a given distance of one of said landings and providing a door zone signal indicative thereof; and said signal processing means comprising means for setting said inhibit means into said second state and providing said door open command in response to the presence of said door zone signal for a time interval indicative of negligible motion of said car within said given distance of said landing concurrently with said failure signal.

5. An elevator according to any of claims 1–4 further characterized by said car including normally on interior lighting and a normally off audible alarm; and said signal processing means comprising means for turning off said interior lighting and turning on said audible alarm concurrently with providing said door opening command.

* * * * *